US006409381B1

(12) United States Patent
Siebenhaar et al.

(10) Patent No.: US 6,409,381 B1
(45) Date of Patent: Jun. 25, 2002

(54) RADIOGRAPHY DEVICE WITH OPERATING CONTROLS LOCATED AT THE X-RAY SYSTEM SUPPORT MECHANISM

(75) Inventors: Rudolf Siebenhaar, Poxdorf; Peter Noegel, Effeltrich, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/477,384

(22) Filed: Jan. 4, 2000

(30) Foreign Application Priority Data

Jan. 11, 1999 (DE) ..... 198 00 677
Nov. 29, 1999 (DE) ..... 199 57 330

(51) Int. Cl.[7] ..... H05G 1/02
(52) U.S. Cl. ..... 378/197; 378/114
(58) Field of Search ..... 378/197, 198, 378/193, 194, 196, 114, 115

(56) References Cited

U.S. PATENT DOCUMENTS 4,979,198 A * 12/1990 Malcolm et al. ..... 378/102
5,008,921 A 4/1991 Kaul et al.
5,838,764 A * 11/1998 Saffer et al. ..... 378/197
6,234,672 B1 * 5/2001 Omasetti et al. ..... 378/197

FOREIGN PATENT DOCUMENTS

DE 88 12 768 1/1989

* cited by examiner

*Primary Examiner*—David P. Porta
(74) *Attorney, Agent, or Firm*—Schiff Hardin & Waite

(57) ABSTRACT

A radiography device has a support mechanism at which an X-ray source, and an X-ray receiver are mounted, the support mechanism being displaceable relative to a component of the radiography device. The radiography device is provided with a device operating assembly which is arranged at the support mechanism. The radiography device can also has a device operating part in the form of an operating handle at the support mechanism.

15 Claims, 6 Drawing Sheets

RADIOGRAPHY DEVICE WITH OPERATING CONTROLS LOCATED AT THE X-RAY SYSTEM SUPPORT MECHANISM

BACKGROUND OF THE INVENTION

1. Field of the Invention

The present invention relates to a radiography device of the type having an X-ray system composed of an X-ray source, an X-ray receiver and a support mechanism that can be displaced relative to a component of the radiography device, the X-ray source and the X-ray receiver being mounted on the support mechanism, and wherein the radiography device is provided with operating controls for operating the radiography device.

2. Description of the Prior Art

A radiography device of the type described above is disclosed in European Application 0 363 507, for instance. This X-ray device has a C-arm as the support mechanism, at which the X-ray source and the X-ray receiver are arranged opposite one another. An operating console for adjusting and displaying parameters for radiographic exposures is arranged on the top of a control box for the radiography device and can be displaced relative to the control box within defined limits.

In the known radiography device it has proven disadvantageous that during the orienting process, a person who is aligning the radiography device, or more particularly the C-arm, for instance relative to a patient, usually does not have the operating console and its displays in his or her field of vision, or can access the operating field only with great difficulty, so that a second person is required to operate the X-ray device in addition to the person performing the alignment of the C-arm.

German utility model 88 12 768 teaches a radiography device of the above described type in which there are switches at the X-ray receiver of the radiography system for actuating electromechanical brakes for locking the support mechanism relative to a device component that holds the support mechanism. Although this allows operation of the radiography device independently of the actual operating controls of the radiography device, such operation is limited to the locking of device components for the radiography device. Convenient operation with simultaneous orienting of the radiography device, particularly the X-ray system, relative to a subject still is not possible, because of the location of these switches at the X-ray receiver.

SUMMARY OF THE INVENTION

It is an object of the present invention to provide a radiography device of the type mentioned above such that the radiography device can be oriented relative to a subject and simultaneously comfortably operated by only one person.

This object is inventively achieved in a radiography device having an X-ray source and an X-ray receiver that are arranged at a support mechanism that can be displaced relative to a device component of the radiography device, and wherein the support mechanism has a device operating assembly for operating the radiography device attached thereto. Because the device operating assembly is attached to the support mechanism for the X-ray source and the X-ray receiver, which must be aligned relative to the patient for radiographic exposures of a body region of the patient, a single person can orient the support mechanism relative to the patient. The person can pivot the support mechanism, adjust the height thereof, or displace it during an organ exam under fluoroscopy and can at the same time operate the radiography device in a comfortable manner, for instance by actuating electrically driven locking brakes for the C-arm, by activating X-ray emission, or by executing the storage of a radiogram. It is thus practically unnecessary for the person to change positions during an orienting procedure in order to operate the radiography device, whether for performing inputs such as entering pick-up parameters at the device operating assembly or for reading displays such as status information.

In an embodiment of the invention, wherein the support mechanism is a C-arm, the device operating assembly is arranged at one of the two ends of the C-arm. As used herein, the "ends of the C-arm" means the respective regions proceeding from the respective points of attachment of the X-ray source and the X-ray receiver to the end faces of the C-arm, if such end faces are present. Since there are usually one or more handles in these regions for orienting the C-bend, for instance relative to a patient to be examined, the radiography device can be oriented relative to a patient in a simple and comfortable manner and can be operated with the aid of the device operating assembly at the same time.

In another embodiment of the invention, the device operating is arranged at one of the two end faces of the C-arm. This arrangement of the device operating assembly at the C-arm has proven particularly expedient because during displacements of the C-arm along its perimeter (orbital movement), the device operating assembly does not interfere with or obstruct the displacement process.

In a further version of the invention the device operating assembly is arranged so as to be displaceable along the perimeter of the C-arm. The device operating assembly thus can be advantageously adjusted with respect to its position at the C-arm.

In another embodiment of the invention the device operating assembly can be removed from the support mechanism. In this way a person can perform device adjustments of the radiography device even at a location remote from the radiography device and can trigger radiographic exposures, for instance.

In another embodiment of the invention the device operating assembly that has been removed from the support mechanism is connected to the support mechanism via a connecting cable, which represents the simplest possible connection from a technical standpoint between the support mechanism and the device operating assembly that is removed therefrom, and which is the least problematic with regard to data transmission. Mechanisms for unwinding, winding and storing the connecting cable can be provided at the C-arm.

In a further version of the invention, the data transmission between the device operating assembly that has been removed from the support mechanism and the radiography device occurs by means of electromagnetic waves. In this way, possibly disruptive cables are avoided between the device operating assembly and the support mechanism. The device operating assembly and the support mechanism are provided with corresponding transmitting and receiving components for electromagnetic waves.

In another embodiment of the invention data transmission between the device operating assembly and a control and computing unit that controls the radiography device occurs by means of electromagnetic waves not only when the device operating assembly has been removed from the support mechanism, but also when it is arranged at the support mechanism. This has the advantage that cabling between the support mechanism and the control and computing unit of the radiography device in relation to the device operating assembly can be omitted. In this form the radiography device has electromagnetic transmitting and receiving components both at the device operating assembly and at the control and computing unit or at a device component that is adjacent to the control and computing unit. In the latter case short connecting cables extend from the electromagnetic transmitting and receiving components to the control and computing unit.

The above object is also inventively achieved in a further version of a radiography device with an X-ray system formed by an X-ray source, an X-ray receiver and a support mechanism that can be adjusted relative to a device component of the radiography device, at which support mechanism the X-ray source and the X-ray receiver are arranged, wherein the X-ray system is provided with a device operating assembly that is constructed in the shape of an operating handle. The operating handle can be formed by a handle and an operating console with operating elements and/or display devices. Because the operating assembly is provided at the X-ray system (that is, at the support mechanism, the X-ray receiver or the X-ray source), a single person can orient the X-ray system relative to the patient (for instance for obtaining radiograms of a body region of a patient) with only one hand. The person can pivot the X-ray system, adjust its height, or displace it for fluoroscopic organ exams, and can at the same time operate the radiography device in a comfortable manner by actuating electrically driven locking brakes for the C-arm, by activating emission of X-rays or by storing a radiogram. It is thus practically unnecessary for the person to change positions during an orienting process in order to operate the radiography device, whether for performing inputs, for instance entering pick-up parameters, at the device operating assembly or for reading displays such as status information.

If in this version the support mechanism is a C-arm, then the operating handle can be arranged at one of the two ends of the C-arm, by which is meant the regions from the respective points of attachment of the X-ray source and the X-ray receiver to the end faces of the C-arm, insofar as these are present.

In another embodiment of the further version of the invention, the operating handle is arranged at one of the two end faces that the C-arm has at its ends. This arrangement of the operating handle at the C-arm is advantageous because the operating handle does not interfere or obstruct the displacement process given displacements of the C-arm along its perimeter (orbital motion).

In another embodiment of the further version of the operating handle is arranged such that it can be displaced along the perimeter of the C-arm. The operating handle thus can be adjusted with respect to its position at the C-arm.

In another embodiment of the further version the invention, the operating handle can be removed from the X-ray system; that is, from the support mechanism, the X-ray receiver or the X-ray source, depending on the point of attachment. In this way, a person can perform adjustments to the X-ray device even at some distance from the device and can trigger radiographic exposures.

In a variant of this embodiment the operating handle that has been removed from the X-ray system is connected to the system via a connecting cable, which affords the same advantages discussed earlier.

In a further variant of this embodiment of the invention, data transmission between the operating handle situated at a location remote from the X-ray system and the radiography device occurs by means of electromagnetic waves. Possibly disturbing cables between the operating handle and the X-ray system are avoided. The operating handle and the X-ray system are provided with corresponding electromagnetic transmitting and receiving connects.

As in the first-described embodiment, in the further embodiment data transmission between the operating handle and a control and computing unit that controls the radiography device occurs by means of electromagnetic waves not only when the operating handle has been removed from the X-ray system but also when it is arranged thereat. This has the advantage that cabling between the X-ray system and the control and computing unit of the radiography device relative to the operating handle can be omitted. In this version the radiography device has electromagnetic transmitting and receiving components both at or in the vicinity of the operating handle and at the control and computing unit, or at a device component adjacent the control and computing unit. In the latter case short connecting cables run from the electromagnetic transmitting and receiving components to the control and computing unit.

DESCRIPTION OF THE PREFERRED EMBODIMENTS

Figure 1:
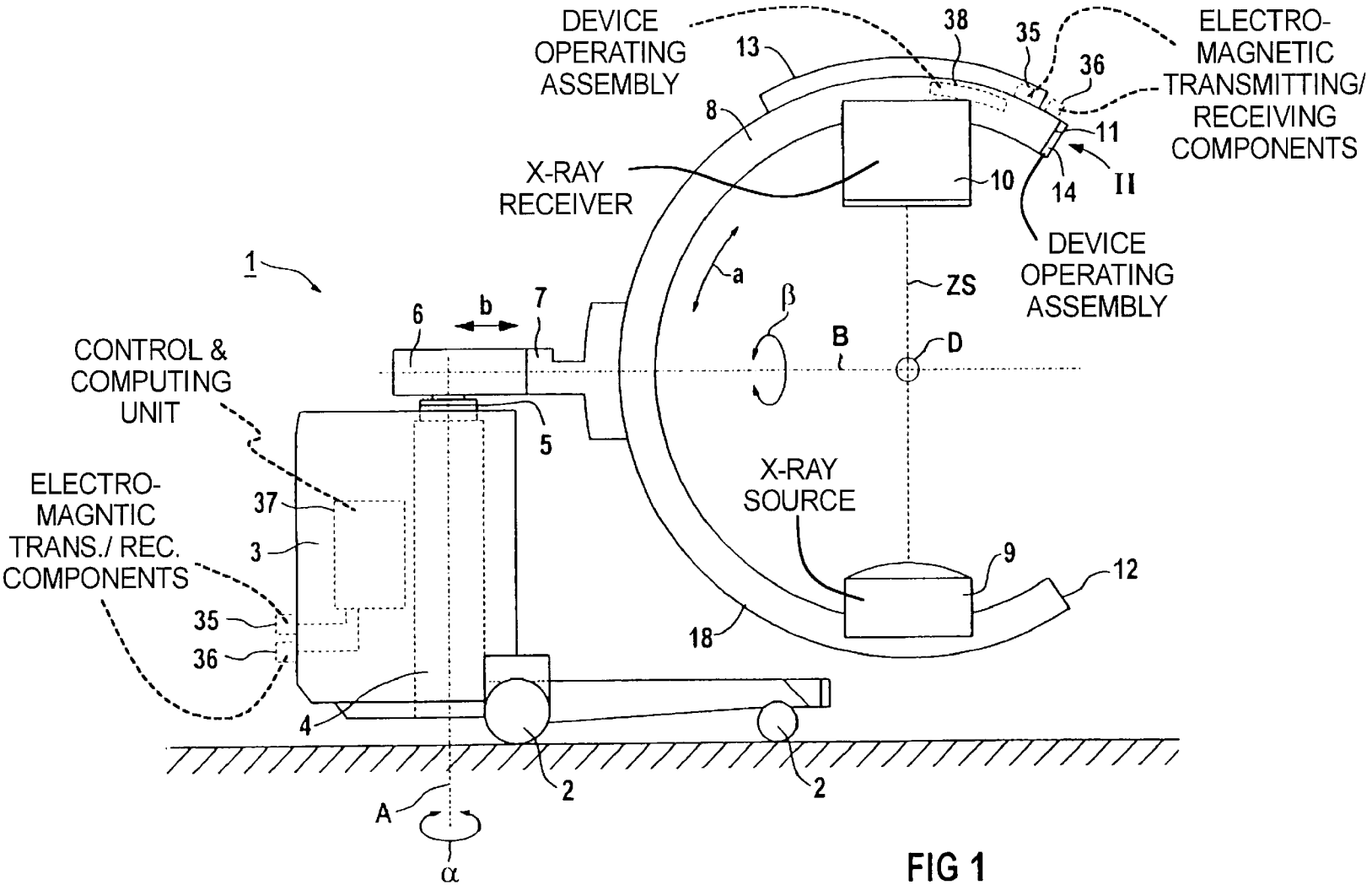
FIG. 1 is a side view of an inventive radiography device with a device operating assembly that is arranged at the support mechanism of the radiography device.

FIG. 1 depicts an inventive radiography device in the form of a C-arm radiography device 1 having a device carriage 3 that can be moved on wheels 2. The C-arm radiography device 1 has a lift mechanism 4 (schematically illustrated in FIG. 1) with a column 5 having a longitudinal axis A, around which the column 5 can be rotated in the directions of the double arrow α. At the column 5 a holder 6 is arranged at which a holder mechanism 7 is in turn mounted for purposes support mechanism that is constructed as a C-arm 8. The C-arm 8 has an X-ray source 9 and an X-ray receiver 10, mounted opposite one another on the C-arm 8 such that a center ray ZS of the X-ray beam emanating from the X-ray source 9 strikes on the detector surface of the X-ray receiver 10 approximately in the middle thereof.

The holder mechanism 7 is mounted at the holder 6 such that it can be rotated around a common axis B of the holder 6 and the holder mechanism 7 in a known manner known (double arrow B, angulation) and can be displaced in the direction of the axis B (cf. double arrow b). The C-arm 8 is mounted such that it can be displaced along its perimeter in the directions of the double arrow a in the holder mechanism 7 relative to the device carriage 3, specifically in an angle range of about 190° (orbital motion). By means of the lift mechanism 4, the C-arm 8, which is connected to the column 5 of the lift mechanism 4 via the holder mechanism 7 and the holder 6, can be displaced vertically relative to the device carriage 3.

The displacement of the C-arm 8 in the holder mechanism 7 occurs isocentrically; that is, the pivot of the C-arm 8 is situated in the beam path of the center ray ZS of the X-ray beam emanating from the X-ray source 9. For displacing the C-arm 8 along its perimeter in the holder mechanism 7 manually, the C-arm 8 is provided with a handle 13 in known fashion for displacing the C-arm 8 around the axis B, or respectively, along the axis B, or for adjusting the height of the C-arm 8.

Figure 2:
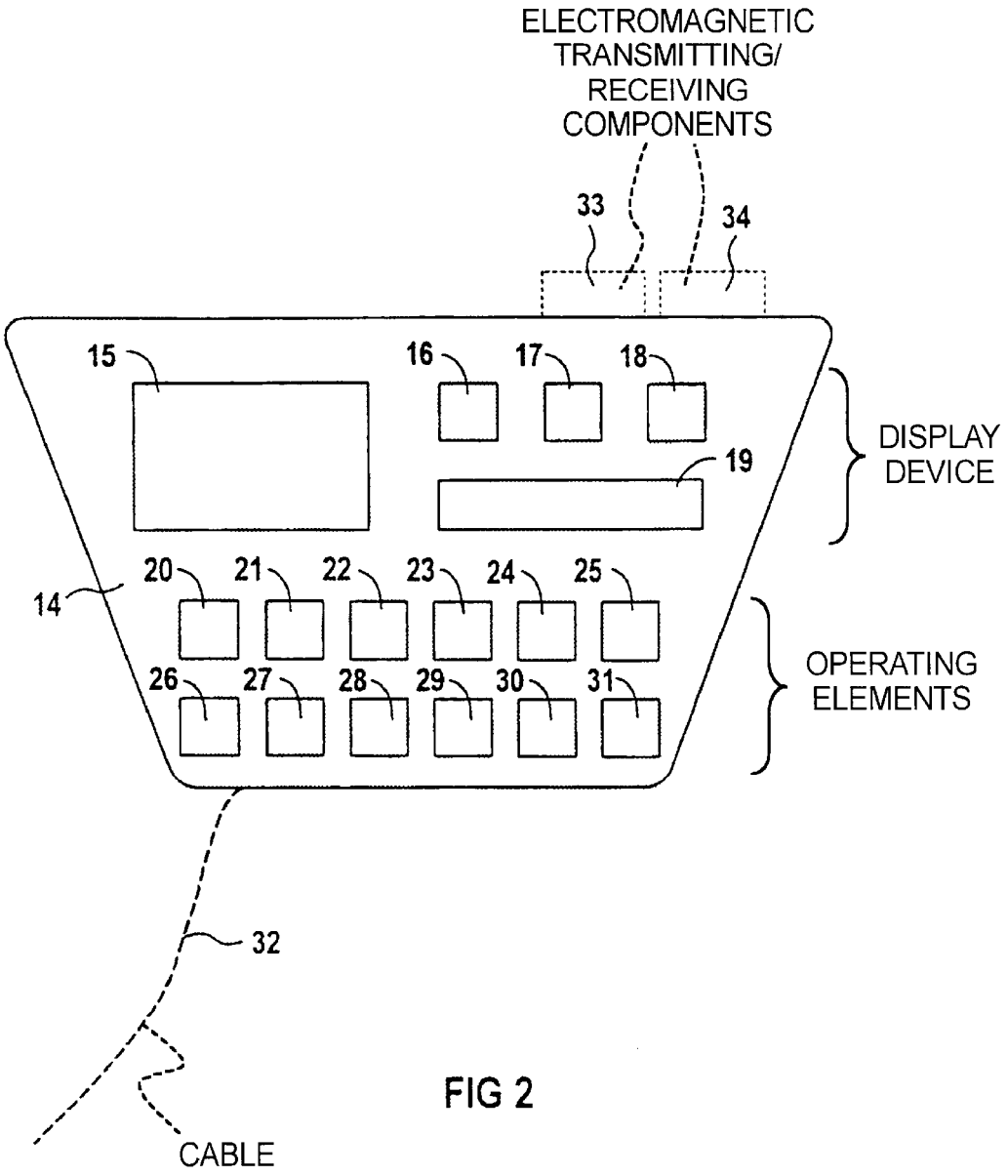
FIG. 2 is a view of the device operating assembly in FIG. 1 as seen in the direction of arrow II in FIG. 1.

The C-arm 8 further has an end faces 11 and 12 respectively at its two ends. In the exemplary embodiment, a device operating component 14 for operating the C-arm radiography device 1 is provided at the end face 11. As can be seen in FIG. 2, which illustrates the view of the device operating assembly 14 in the direction of arrow II from FIG. 1, the device operating assembly 14 includes-display devices 15 to 19 and operating elements 20 to 31 in the form of operating buttons.

The device operating assembly 14 contains all display devices and operating elements that are necessary in order to operate the C-arm radiography device 1; that is, using the display devices 15 to 19 status information of the C-arm radiography device 1 can be displayed, and using the operating elements 20 to 31 it is possible to actuate electrically operated brakes, for instance for immobilizing the lift column 5 or the C-arm 8, to enter or retrieve device parameters and exposure parameters, and to store radiograms and trigger radiographic exposures. In addition to the device operating assembly 14, a functionally similar operating field can be arranged at the device carriage 3 in a customary manner that is not illustrated in FIG. 1. In this case, the C-arm radiography device 1 can be operated via the additional operating field that is arranged at the device carriage 3 and/or using the device operating assembly 14 alternatively or in a parallel manner.

The device operating assembly 14 need not necessarily be attached at the end face 11 of the C-arm 8, but can be attached at the end face 12. It is also possible to provide each of the end faces 11 and 12 of the C-arm with a device component assembly 14 if necessary or expedient.

The arrangement of the device operating assembly 14 at the end face 11 of the C-arm 8 makes it possible for an operator (who is not illustrated in FIG. 1) to orient the C-arm radiography device 1, or the C-arm 8 thereof, relative to a patient (not illustrated in FIG. 1) using the handle 13, for obtaining radiographic exposures of a body region of the patient, and at the same time allows the operator to have access to the operating elements 20 to 31 of the device operating assembly 14, or to have the display devices 15 to 19 of the device operating assembly 14 in his or her field of vision.

Instead of the device operating assembly 14 that is arranged at the end face 11, a functionally similar device operating assembly can be provided which is arranged at one of the end regions of the C-arm 8; that is, in a region between the attachment location of the X-ray source 9 and the end face 12 or in the region between the attachment location of the X-ray receiver 10 and the end face 11. This type of device operating assembly 38 that is arranged between the attachment location of the X-ray receiver 10 and the end face 11 is illustrated in FIG. 1 by dotted lines.

In the exemplary embodiment, the device operating assembly 14 can be removed from the C-arm 8. In this way, an operator can also operate the C-arm radiography device 1 using the device operating assembly 14 from a distance so that, for example, device settings can be modified or radiographic exposures of a body region of a patient can be triggered from a safe distance. The operator thus can modify exposure parameters without having to approach the C-arm radiography device 1 This is particularly advantageous when the C-arm 8 can be displaced by motor, so that subsequent to a displacement of the C-arm 8 relative to the patient using the device operating part 14, a radiographic exposure with modified parameters that have been adapted to the respective anatomy of the patient can be accomplished with the device operating assembly 14.

The C-arm 8 and the device operating assembly 14 can be connected in a hardwired manner by a connecting cable 32, which is illustrated only schematically in FIG. 2, or in a wireless manner by transmitting and receiving components 33 and 34 for electromagnetic waves, which are likewise only schematically illustrated in FIG. 2. In the case of wireless data transmission between the device operating part 14 and the C-arm 8, corresponding electromagnetic transmitting and receiving components 35, and 36 which are only schematically illustrated in FIG. 1, are arranged at the C-arm 8.

The transmitting and receiving components 35 and 36 need not necessarily be arranged at the C-arm 8, but alternatively can be arranged at a different device component of the C-arm radiography device 1, for instance at the device carriage 3.

Figure 3:
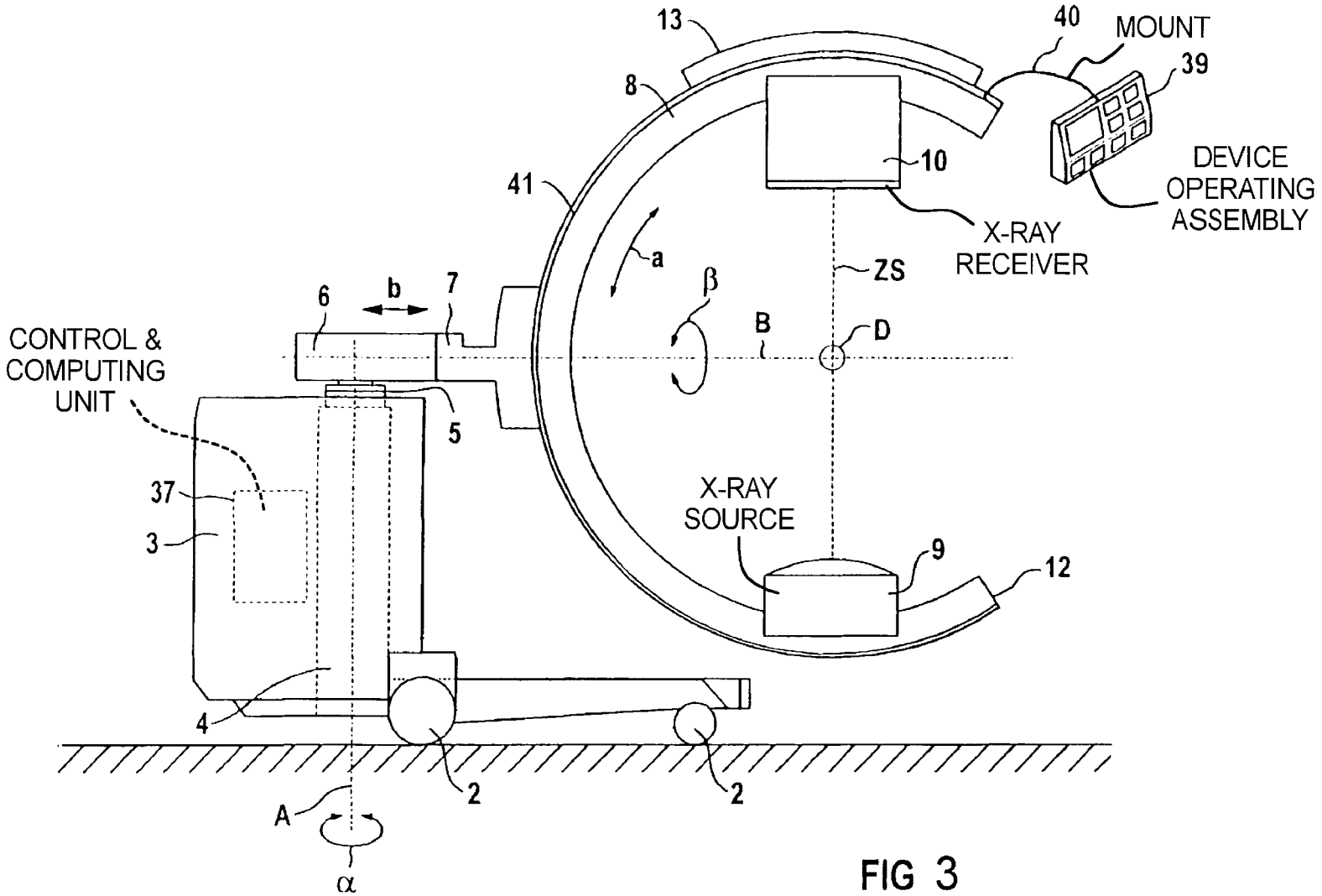
FIG. 3 is a side view of a second embodiment of an inventive radiography device having a device operating assembly arranged at the support mechanism of the radiography device.

FIG. 3 depicts a second embodiment of an inventive radiography device, which is largely identical to the C-arm radiography device 1 illustrated in FIG. 1 in structure and function. Therefore, device components of the C-arm radiography device illustrated in FIG. 3 which correspond to components of the C-arm radiography device 1 illustrated in FIG. 1 are provided with the same reference characters.

Unlike the C-arm radiography device 1 illustrated in FIG. 1, the device operating assembly 39 of the C-arm radiography device illustrated in FIG. 3 is not arranged at one of the end faces of the C-arm 8, but at a mount 40 that is mounted in a rail 41 running along the perimeter of the C-arm 8 such that the retainer can be displaced therein. Locking means such as clamps (which are not illustrated in FIG. 3) are allocated to the mount 40, so that the mount 40 can be fixed in a desired position. In this way, the device operating assembly 39 can be moved into an operating position that is favorable to an operator, depending on the position of the C-arm 8.

The mount 40 is preferably constructed so as to permit further adjustment of the device operating assembly 39. The mount 40 may be, for example, a swan-neck or an articulated arm.

The device operating assembly 39 need not necessarily be arranged at a mount 40, but alternatively can be mounted directly in the rail 41 of the C-arm 8 such that it can be displaced along the rail 41.

Beyond this, additional rails or other displacement arrangements can be provided at the C-arm 8 in which it is possible to displace the mount 40, or the device operating assembly 39 along the perimeter of the C-arm 8.

It is also possible to provide only a few mounting locations at particularly suitable points along at the C-arm 8 at which the device operating assembly 39 can be fastened.

As in the case of the exemplary embodiment described in FIG. 1, the device operating assembly 39 can be removed from the C-arm 8. The device operating assembly 39 can be connected to the C-arm 8 in turn in a hardwired manner by means of a connecting cable (which is not illustrated in FIG. 3) or in a wireless manner with transmitting and receiving components (likewise not illustrated in FIG. 3) at the device operating assembly 39 and the C-arm 8, or at some other component of the C-arm radiography device, for instance the device carriage 3 illustrated in FIG. 3.

Figure 4:
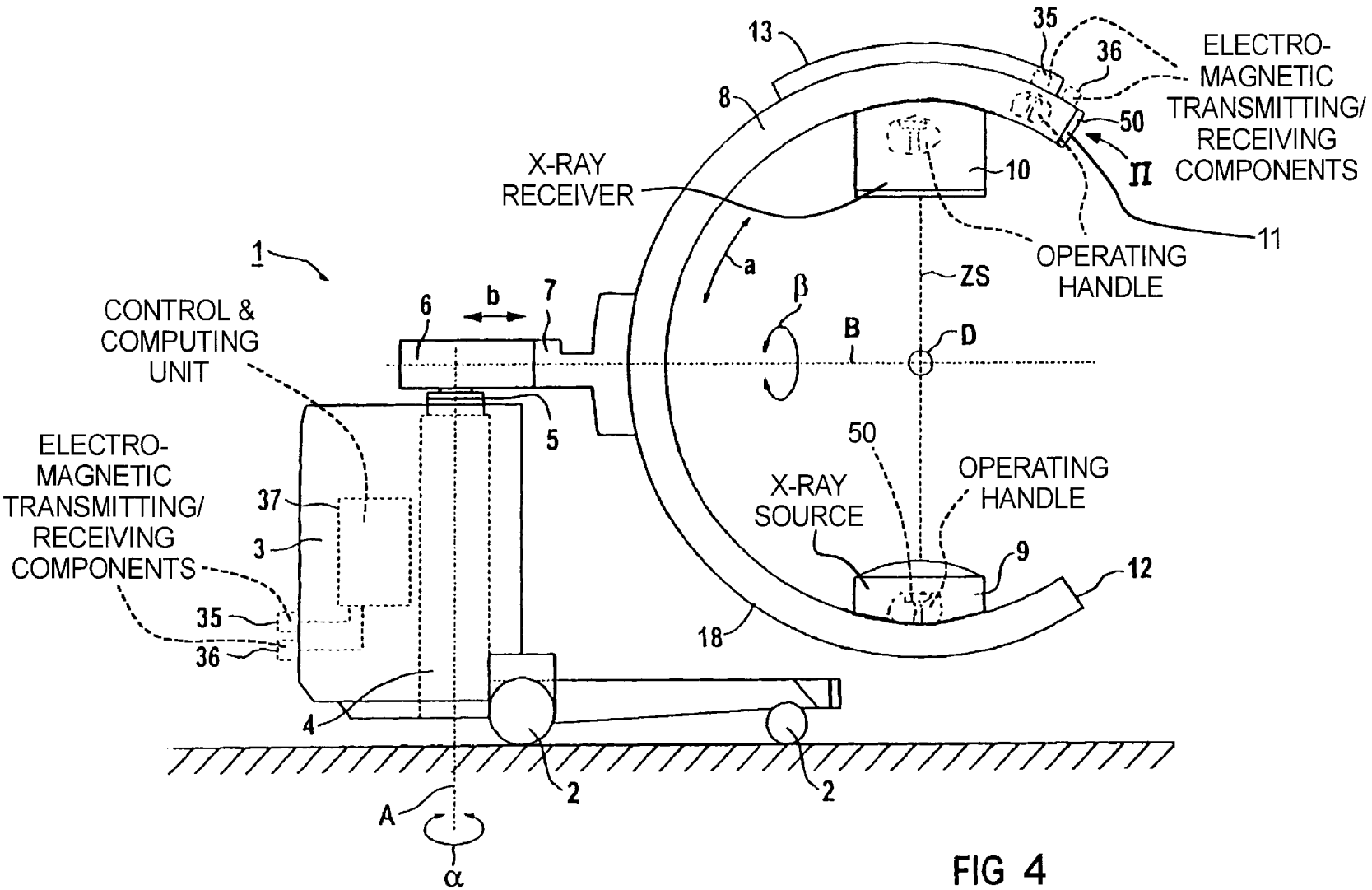
FIG. 4 is a side view of a third embodiment of an inventive radiography device having an operating handle that is arranged at the support mechanism of the radiography device.

FIG. 4 depicts another embodiment of an inventive radiography device which is largely identical in structure and function to the C-arm radiography device 1 illustrated in FIG. 1. Device components of the C-arm radiography device illustrated in FIG. 4 that correspond to the components of the C-arm radiography device 1 illustrated in FIG. 1 are provided with the same reference characters.

Figure 5:
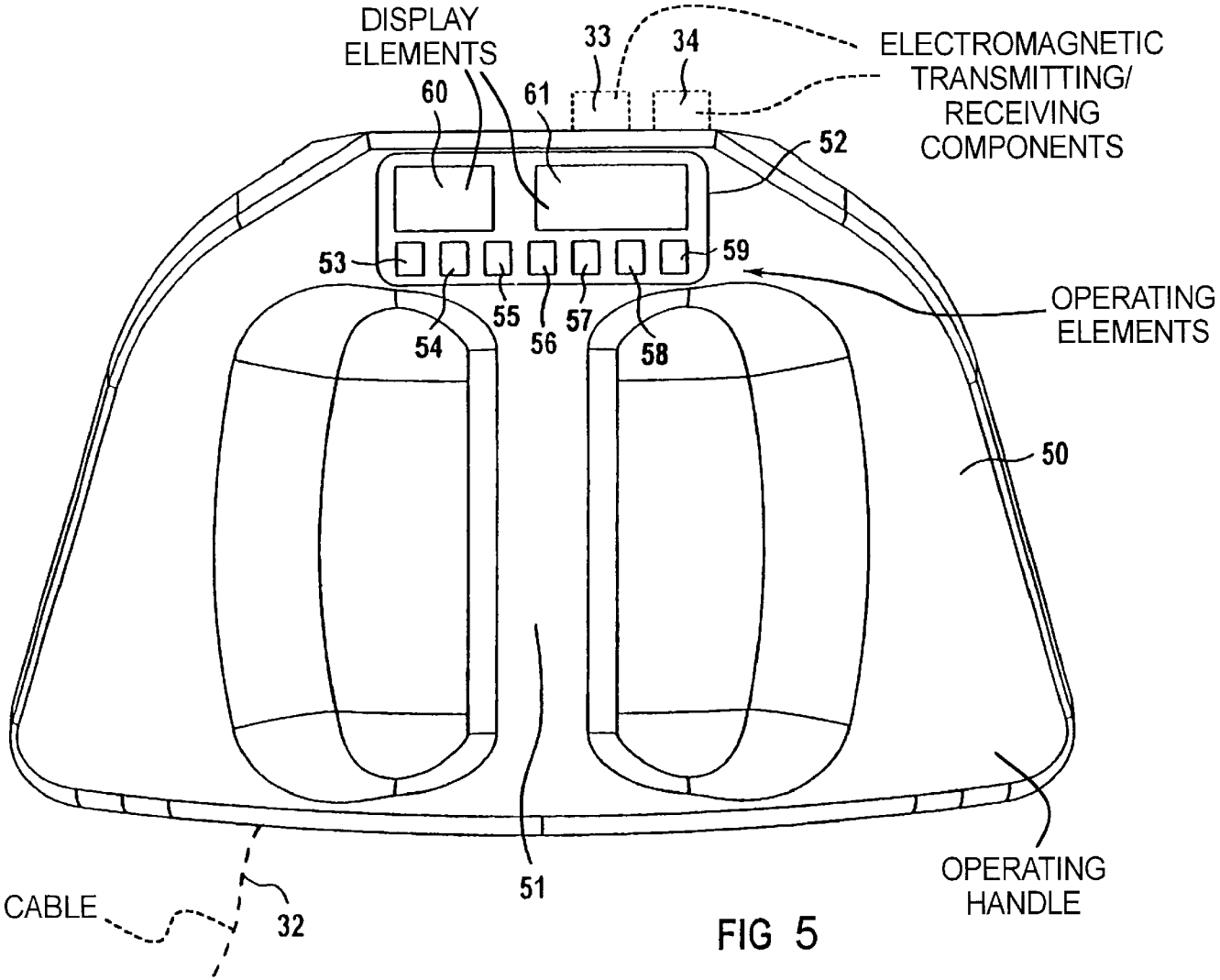
FIG. 5 is a view of the operating handle of FIG. 4 as seen in the direction of arrow V in FIG. 4.

Unlike the C-arm radiography device 1 illustrated in FIG. 1, the C-arm radiography device illustrated in FIG. 4 has as a device operating assembly an operating handle 50 that is provided for operating the C-arm radiography device and for displacing the X-ray system formed by C-arm 8, the X-ray source 9 and the X-ray receiver 10. The handle 50 is arranged at the end face 11 of the C-arm 8 in the exemplary embodiment. FIG. 5 depicts the view of the operating handle 50 in the direction of the arrow V in FIG. 4.

As can be seen in FIG. 5, the operating handle 50 includes a gripping element 51 and an operating field 52. The operating field 52 is provided with operating elements 53 to 59 in the form of operating buttons and with display devices 60,61. In the exemplary embodiment, the operating field 52, and thus the operating handle 50, contains all display devices and operating elements that are required in order to operate the C-arm radiography device; that is, using the display devices 61,62 status information of the C-arm radiography device can be displayed, and using the operating elements 53 to 59, electrically operated brakes can be actuated, for instance for immobilizing the lifting column 5 or the C-arm 8, and device and exposure parameters can be entered, or retrieved, radiograms can be stored, and radiographic exposures can be triggered. The operating handle 50 thus enables a person to orient the C-arm radiography device, or the C-arm thereof 8 relative to a person to be examined with the C-arm radiography device in a simple manner and at the same time to operate the device via the operating field 52.

In addition to the operating handle 50, a functionally identical operating field can be arranged at the device carriage 3 in a conventional manner that is not illustrated in FIG. 4, as in the case of the C-arm radiography device 1. In this case, the C-arm radiography device can be operated via the additional operating field that is arranged at the device carriage 3 and/or by means of the operating handle 50 alternatively or in a parallel manner.

The operating handle 50 need not necessarily be arranged at the end face 11 of the C-arm 8, but alternatively may also be arranged at the end face 12. It is also possible to provide both end faces 11, 12 with an operating handle 50 if necessary expedient.

The operating handle 50 need not necessarily be arranged at one of the end faces 11, 12 of the C-arm 8. Alternatively, it can be arranged at an end regions of the C-arm 8, i.e. in the region between the point of attachment of the X-ray source 9 and the end face 12 or in the region between the point of attachment of the X-ray receiver 10 and the end face 11. Such an operating handle 50 that is arranged between the point of attachment of the X-ray receiver 10 and the end face 11 is illustrated in FIG. 4 by dotted lines.

The operating handle 50 also can be arranged at the X-ray source 9 or at the X-ray receiver 10, as illustrated in FIG. 4 by dotted lines.

The operating handle 50 can be arranged fixedly at the C-arm 8, the X-ray source 9 or the X-ray receiver 10, or it can be removable from the C-arm 8, the X-ray source 9 or the X-ray receiver 10.

In the exemplary embodiment, the operating handle 50 can be removed from the C-arm 8. In this way, an operator can also operate the C-arm radiography device 1 from a distance using the operating handle 50 to modify device settings or to trigger radiographic exposures of a body region of a patient from a safe distance. The operator thus can perform adjustments to exposure parameters without having to approach the C-arm radiography device. This is particularly advantageous when the C-arm 8 can also be displaced by motor, so that subsequent to a displacement of the C-bend 8 relative to the patient performed using the operating handle 50, a radiographic exposure with modified parameters that have been adapted to the respective anatomy of the patient can be triggered using the operating handle 50.

The C-arm 8 and the operating handle 50 can be connected in a hardwired manner by a connecting cable 32 (which is only schematically illustrated in FIG. 5) or in a wireless manner using transmitting and receiving components 33 and 34 for electromagnetic waves (which are also only schematically illustrated in FIG. 5). In the case of wireless transmission between the operating handle 50 and the C-arm 8, corresponding electromagnetic transmitting and receiving components 35 and 36 are arranged at the C-arm 8 (which are only schematically illustrated in FIG. 4).

The electromagnetic transmitting and receiving components 35 and 36 need not necessarily be arranged at the C-arm; rather, they be arranged at another device component of the C-arm radiography device, for instance at the device carriage 3.

In the exemplary, embodiment, the operating handle 50 cooperates with the control and computing unit 37 of the C-arm radiography device. The control commands, settings and parameters that are entered using the operating handle 50 are conducted to the control and computing unit 37 via connecting cables running inside the C-arm radiography device 1 between the operating handle 50, or the transmitting and receiving components 35 and 36, and the control and computing unit 37 (such cables are not illustrated in all instances in FIG. 4 and are only schematically indicated as examples). The unit 37 transmits information that is to be displayed to the operating handle 50 via the connecting cables and possibly via the transmitting and receiving components 35 and 36.

Figure 6:
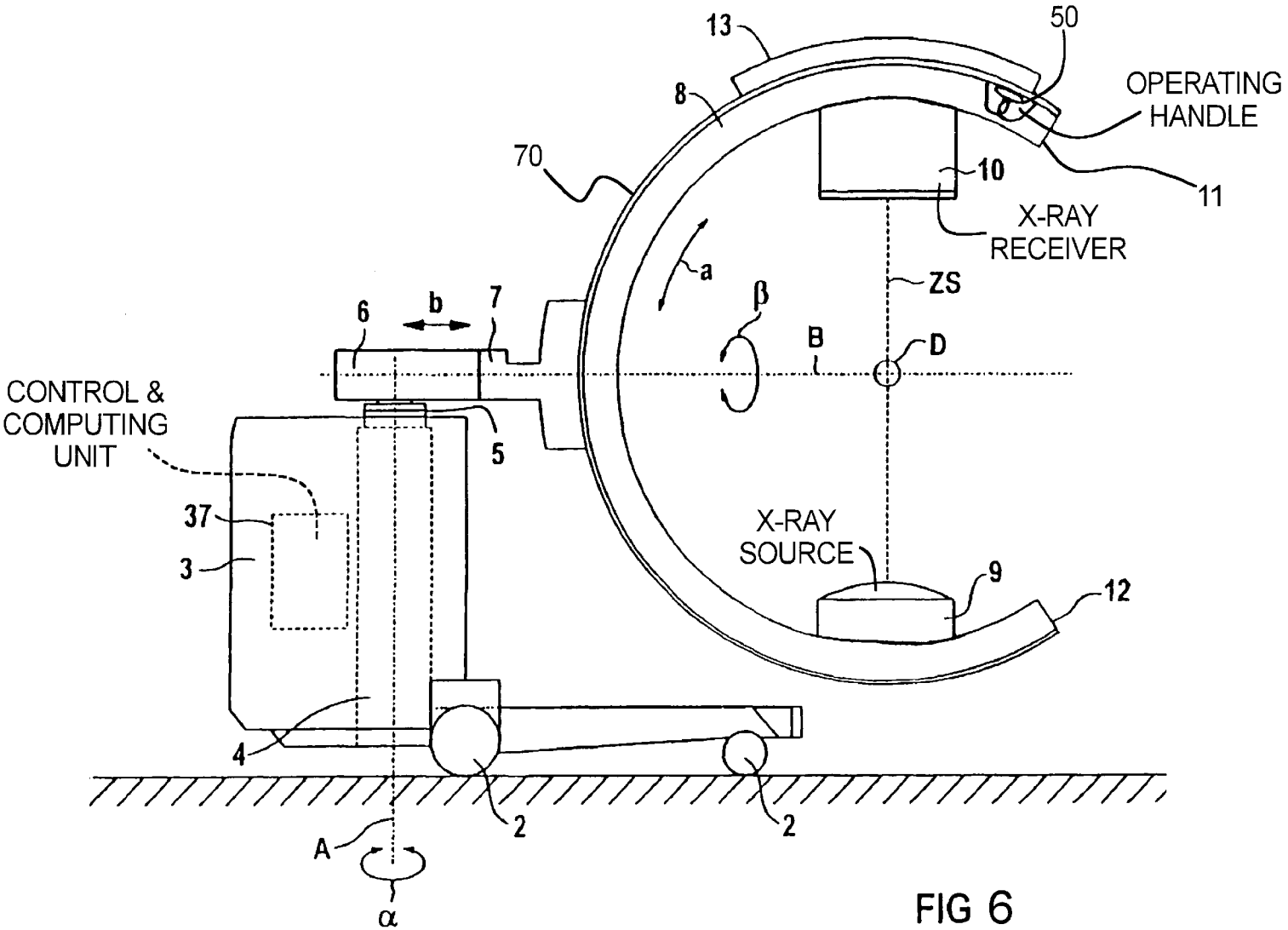
FIG. 6 is a side view of another embodiment of an inventive radiography device having n operating handle.

FIG. 6 depicts a second embodiment of an inventive radiography device with an operating handle, which is largely identical in structure and function to the C-arm radiography device illustrated in FIG. 4. Device components of the C-arm radiography device illustrated in FIG. 6 that correspond to components of the C-arm radiography device illustrated in FIG. 4 are provided with the same reference characters.

Unlike the C-arm radiography device illustrated in FIG. 4, the operating handle 50 of the C-arm radiography device illustrated in FIG. 6 is not arranged at one of the end faces of the C-arm 8; rather, it is mounted at a rail 70 running along the perimeter of the C-arm 8 such that it can be displaced. Locking means such as clamps (which are not illustrated in FIG. 6) are allocated to the operating handle 50, so that the operating handle 50 can be fixed in a desired position. In this way the operating handle 50 can be moved into an operating position that is favorable to the operator according to the position of the C-arm 8.

Additional rails or other types of displacing arrangement can be provided at the C-arm 8, so that the operating handle 50 can be displaced along the perimeter of the C-arm 8.

It is also possible to provide only a few fixing locations at particularly well-suited points along the C-arm 8 at which the operating handle 50 can be fastened.

As in the exemplary embodiment described in FIG. 4, the operating handle 50 can be removed from the C-arm 8. The operating handle 50 can be connected to the C-arm 8 in a hardwired manner by means of a connecting cable (which is not illustrated in FIG. 6) or in a wireless manner by electromagnetic transmitting and receiving components (which are not illustrated in FIG. 6) at the operating handle 50 and the C-arm 8, or at some other component of the C-arm radiography device, for instance the device carriage 3 illustrated in FIG. 6.

The invention has been described herein based on the example of a support mechanism in the form of a C-arm. The support mechanism need not necessarily be a C-arm, but can be constructed differently. Instead of the C-arm support mechanism, a U-shaped support mechanism can be provided for the X-ray source 9 and the X-ray receiver 10.

The embodiments of the above described device operating assemblies 14, 39 and the embodiment of the operating handle 50 and the embodiments of the above described C-arm radiography devices an intended merely as exemplary and can be constructed differently in the context of the invention. In particular, hybrids of the exemplary embodiments illustrated in FIGS. 1, 3, 4 and 6 are also possible.

Furthermore, the radiography device need not be constructed so as to be movable on the floor; rather, the inventive radiography device be a radiography device with a ceiling-suspended or floor-mounted C-arm that is arranged at an articulated arm, for example.

In addition, the device operating assemblies 14, 39 and the operating handle 50 need not include both operating elements and display devices, but can include comprise only operating elements or only display devices.

Although modifications and changes may be suggested by those skilled in the art, it is the intention of the inventors to embody within the patent warranted hereon all changes and modifications as reasonably and properly come within the scope of their contribution to the art.

We claim as our invention:

1. A radiography device comprising:

a device component;

an X-ray source and an X-ray receiver;

a support mechanism having a C-arm on which said X-ray source and said X-ray receiver are mounted, said C-arm being connected to and displaceable relative to said device component, said C-arm having a perimeter; and a device operating assembly mounted at said perimeter of said C-arm and being displaceable long said perimeter, said device operating assembly containing controls for at least one of displacing said C-arm and obtaining a radiographic exposure using said X-ray source and said X-ray receiver.

2. A radiology device as claimed in claim 1 wherein said device operating assembly is removably mounted at said C-arm.

3. A radiology device as claimed in claim 2 comprising a connecting cable for connecting said device operating assembly to said C-arm when said device operating assembly is removed from said C-arm.

4. A radiography device as claimed in claim 2 further comprising an electromagnetic data transmission arrangement having components respectively disposed at said C-arm and at said device operating assembly for allowing electromagnetic communication between said device operating assembly and said C-arm when said device operating assembly is removed from said support mechanism.

5. A radiography device as claimed in claim 1 further comprising a control and computing unit for operating said support mechanism and said X-ray source and said X-ray receiver, and further comprising an electromagnetic transmitting and receiving arrangement for electromagnetically exchanging signals between said device operating assembly and said control and computing unit.

6. A radiography device comprising:

a device component;

an X-ray system connected to said device component, said X-ray system including an X-ray source, an X-ray receiver and a support mechanism on which said X-ray source and said X-ray receiver are mounted, said support mechanism being displaceable relative to said device component; and an operating handle at said X-ray system for controlling displacement of said support mechanism and for controlling obtaining an X-ray exposure with said X-ray source and said X-ray receiver from said operating handle.

7. A radiography device as claimed in claim 6 wherein said operating handle comprises a gripping element, and an operating field containing at least one of operating elements and display elements.

8. A radiography device as claimed in claim 6 wherein said support mechanism is a C-arm.

9. A radiography device as claimed in claim 8 wherein said C-arm has two opposite ends, and wherein said operating handle is disposed at one of said two ends.

10. A radiography device as claimed in claim 9 wherein said C-arm has two end faces respectively at said two ends, and wherein said operating handle is disposed at one of said two end faces.

11. A radiography device as claimed in claim 8 wherein said C-arm has a perimeter, and wherein said operating handle is mounted at said perimeter for displacement along said perimeter.

12. A radiography device as claimed in claim 6 wherein said operating handle is removably mounted at said support mechanism.

13. A radiography device as claimed in claim 12 comprising a connecting cable for connecting said operating handle to said support mechanism when said operating handle is removed from said support mechanism.

14. A radiography device as claimed in claim 12 further comprising an electromagnetic data transmission arrangement having components respectively disposed at said support mechanism and at said operating handle for allowing electromagnetic communication between said operating handle and said support mechanism when said operating handle is removed from said support mechanism.

15. A radiography device as claimed in claim 6 further comprising a control and computing unit for operating said support mechanism and said X-ray source and said X-ray receiver, and further comprising an electromagnetic transmitting and receiving arrangement for electromagnetically exchanging signals between said operating handle and said control and computing unit.

* * * * *